US005921001A

United States Patent [19]

Hartwig

[11] Patent Number: 5,921,001

[45] Date of Patent: Jul. 13, 1999

[54] OSCILLATING FEEDER WITH OPPOSING FEED ANGLE

[75] Inventor: Heath L. Hartwig, Waterloo, Iowa

[73] Assignee: Consolidated Process Machinery, Inc., Merrimack, N.H.

[21] Appl. No.: 09/020,039

[22] Filed: Feb. 6, 1998

Related U.S. Application Data

[51] Int. Cl.[6] ..... F26B 19/00

[52] U.S. Cl. ..... 34/205; 34/207; 34/217; 34/227

[58] Field of Search ..... 34/62, 168, 182, 34/188, 203, 205, 207, 217, 227, 235, 236, 238; 198/952; 62/373, 378

[56] References Cited

U.S. PATENT DOCUMENTS

| | | | |
|---|---|---|---|
| 4,445,282 | 5/1984 | Heinemans | 34/168 |
| 5,341,580 | 8/1994 | Teal | 34/218 X |
| 5,375,342 | 12/1994 | Giesler | 34/168 |
| 5,653,044 | 8/1997 | Thom, Jr. | 34/217 |
| 5,664,338 | 9/1997 | Thom, Jr. | 34/62 |
| 5,701,683 | 12/1997 | Wilhlem | 34/394 |
| 5,709,035 | 1/1998 | Wilhelm | 34/167 |

*Primary Examiner*—Henry Bennett
*Assistant Examiner*—Steve Gravini
*Attorney, Agent, or Firm*—Nixon & Vanderhye

[57] ABSTRACT

The cooler/dryer includes a product inlet having an inlet discharge chute oscillatable about a horizontal axis corresponding to the direction of conveyance of the product within the dryer/cooler. The chute is at an opposite angle to the direction of conveyance and drops product onto a seal plate angled in the direction of conveyance. Through the combined oscillating motion of the chute and the opposed feed angles of the chute and seal plates in relation to the conveyor, an air seal between the conveyor and the seal plate and level distribution of product across the conveyor are provided. A secondary pivoting seal downstream from the inlet prevents air drawn in through the inlet along with the product from passing directly into the cooling/drying chamber.

7 Claims, 3 Drawing Sheets

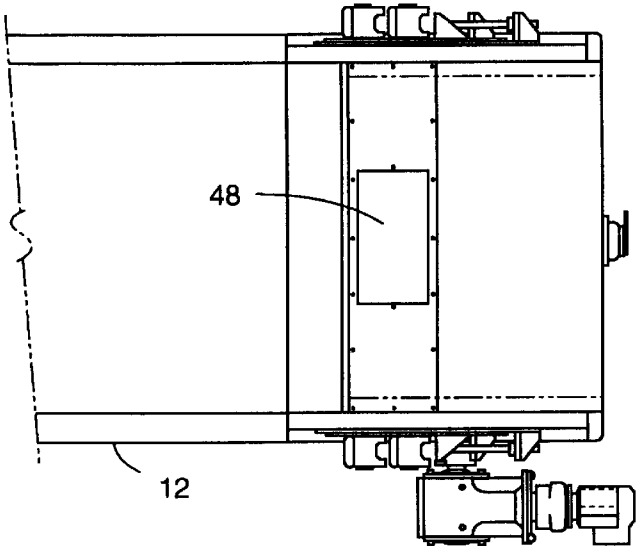
Fig. 4
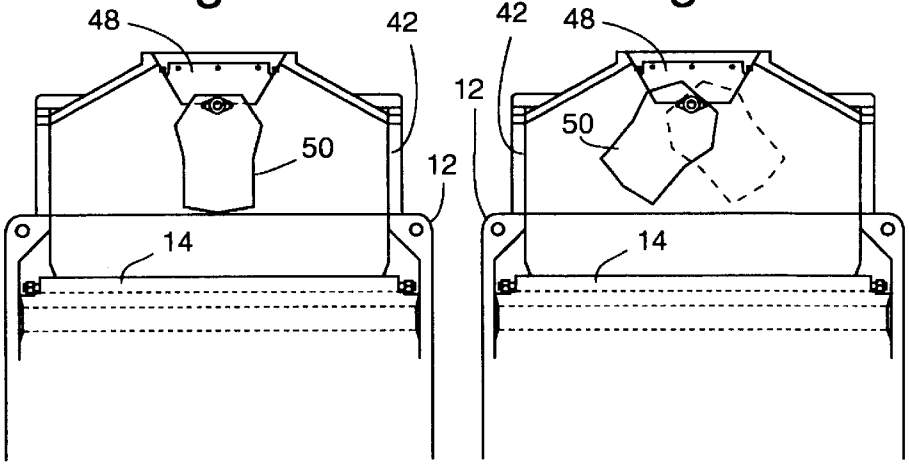
Fig. 5
Fig. 6
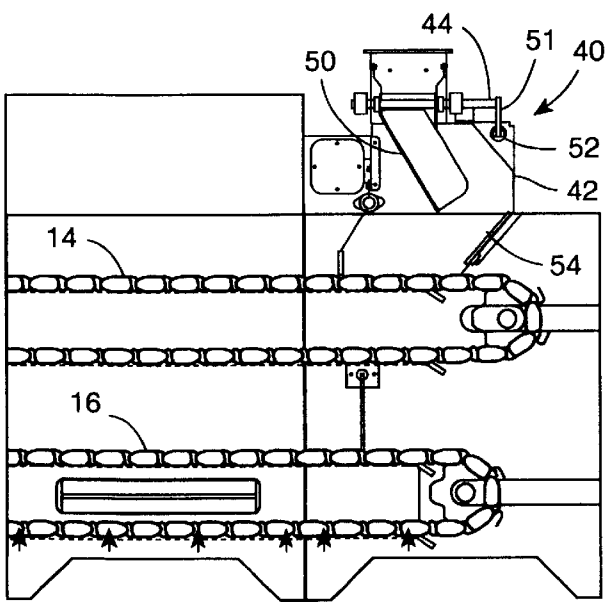
Fig. 3

OSCILLATING FEEDER WITH OPPOSING FEED ANGLE

TECHNICAL FIELD

The present invention relates generally to coolers and dryers for agricultural products such as pellets, flakes, meal and expandate products and more particularly to a horizontal cooler and dryer having an improved product inlet achieving a consistently level product bed and forming a unique seal between the product conveyor and rear inlet seal.

BACKGROUND OF THE INVENTION

Coolers/dryers for agricultural products such as pellets, flakes, meal, expandate products and the like are well known in the industry. These cooler/dryers have conveyors which generally take the form of pans for receiving the product and conveying the product through a gas chamber, typically air, where the product is dried and cooled. A typical example of a cooler/dryer of this type is disclosed in U.S. Pat. No. 5,653,044, of common assignee-herewith. As disclosed in that patent, product flows through an inlet to the cooler/dryer housing onto an upper conveyor which conveys the product through a chamber receiving cooling/drying gas, e.g., air, from side vent openings, i.e., inlets through the side walls of the housing. The upper conveyor discharges the product onto an underlying conveyor which also flows through the chamber for drying/cooling the product prior to discharge at the end of the underlying conveyor. A negative suction is applied to a gas outlet at the top of the housing so that gas passing through the chamber cools and dries the product on the conveyors.

While the cooler/dryer of that patent has performed satisfactorily, two problems remain unique to coolers/dryers of this type. First, the cooler/dryer inlet or feeder must provide a consistent level bed of product on the conveyor to ensure that the product is evenly cooled/dried across the entirety of the conveyor bed. Various devices have been employed to spread the product across the conveyor bed and use of those devices themselves may cause additional problems in the cooler/dryer. Secondly, cooling/drying air must not be allowed to cycle around the bed of product, reducing the effectiveness of the entire system. For example, with the product inlet at the top of the machine housing and air being drawn in through the sides of the housing for discharge through the air exhaust at the top of the housing, there remains the possibility of air bypassing the cooling/drying chamber, particularly about the rear inlet seal, hence minimizing the effectiveness of the flow of air from the air inlets past the product on the conveyors.

DISCLOSURE OF THE INVENTION

In accordance with the present invention, there is provided a cooler/dryer having a novel feeder or product inlet arrangement which provides a level consistent bed of product between opposite transverse sides of the conveyor, while at the same time provides a unique air seal between the conveyor and the rear inlet seal which avoids cycling air from the air inlets past the product receiving portion of the conveyor directly below the product inlet directly to the air discharge which would otherwise reduce cooling/drying effectiveness. To accomplish this, the present invention provides a product inlet along an upper surface of the machine housing and which inlet includes a chute movable to spread product substantially evenly between opposite sides of the conveyor. Additionally, the product inlet includes a rear inlet seal. To maintain the bed consistently level from side to side, as well as provide an air seal between the conveyor and the rear inlet seal, the chute, and hence the product flow, are directed opposite to the direction of conveyance of the product on the conveyor and against an angled plate forming the rear inlet seal. The rear inlet seal plate is angled in the direction of conveyance of the product. Thus, product is conveyed by the chute in a rearward direction and against the forwardly angled plate. The movement of the chute and conveyor and the product flow are controlled to maintain product between the conveyor and angled seal plate during one complete cycle of movement of the chute. In this manner, sufficient product remains between the conveyor and the angled seal plate at all times during operation and especially when the chute discharges remotely from transverse locations along the conveyor to maintain a seal between the conveyor and the angled seal plate.

In a preferred embodiment according to the present invention, there is provided a horizontal cooler/dryer comprising a housing having a product inlet, a product discharge, a gas inlet, a gas exhaust, and a gas chamber for passing gas from the gas inlet to said gas exhaust, a conveyor within the housing for receiving product from the product inlet and conveying the product in a first direction from the product inlet through the gas chamber to the product discharge to cool and dry the product, a seal plate carried by the housing above the conveyor and angled in the direction of conveyance of the product on the conveyor, the product inlet including a chute for receiving product from an external source and flowing the product onto the plate in a direction generally opposite to the direction of conveyance of the product on the conveyor, thereby forming an air seal between the conveyor and the seal plate.

Accordingly, it is a primary object of the present invention to provide a horizontal cooler/dryer for agricultural products such as pellets, flakes, meal and expandate products, having improved cooling and drying by consistently providing a level bed and an air seal between the conveyor and the rear inlet seal plate preventing bypass of cooling/drying air around the product.

BRIEF DESCRIPTION OF THE DRAWINGS

FIG. 3 is a fragmentary view of product inlet and discharge ends of a cooler/dryer according to the present invention illustrating the novel product inlet;

FIG. 4 is a top plan view thereof;

FIGS. 5 and 6 are schematic partial end views illustrating the product inlet with the chute in various positions;

DETAILED DESCRIPTION OF THE DRAWINGS

Figure 2:
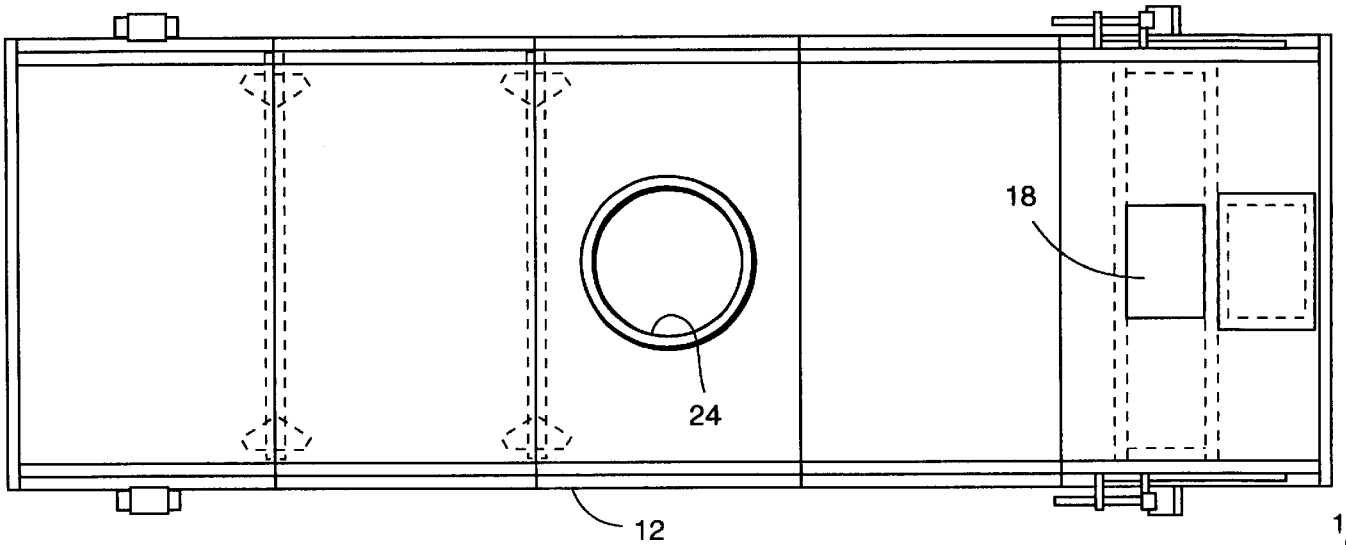
Fig. 2 (PRIOR ART)
FIG. 2 is a top plan view of the prior art design of FIG. 1.
Figure 1:
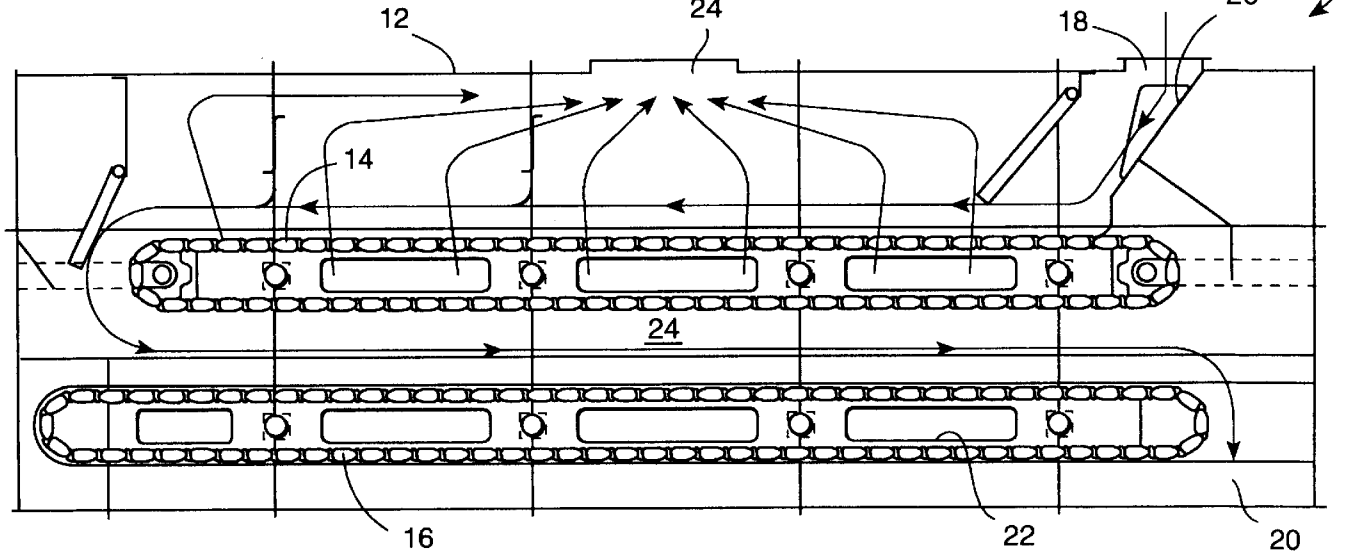
Fig. 1 (PRIOR ART)
FIG. 1 is a schematic side elevational view of a cooler/dryer according to a prior art design.

Referring now to the drawings and particularly to FIGS. 1 and 2, there is illustrated a horizontal cooler/dryer of the prior art, generally designated 10, for use in transporting agricultural material such as pellets, collets, flakes, meal and expandate products, through a drying zone within the cooler/dryer 10. In FIG. 1, the cooler/dryer 10 includes a housing 12 having an upper conveyor 14 and a lower conveyor 16, a product inlet 18 and a product discharge 20. The conveyors are of the pan type, described and illustrated in the prior U.S. Pat. No. 5,653,044, the disclosure of which is incorporated herein by reference. Drying/cooling gas, i.e., air, is inlet into the housing 12 through openings 22 in opposite sides of the housing 12 for flowing air upwardly through the cooling/ drying chamber 24 and about the product such that the cooling/drying air exits through an air discharge 24 along the top of the housing 12. It will be appreciated from a review of FIG. 1 that the inlet 18 receives product, for example, pellets, for passage along a surface 26 angled in the direction of conveyance of the product along the upper conveyor 14, the upper conveyor displacing the products in the direction of the arrows illustrated in FIG. 1. The upper conveyor 14 discharges product onto the inlet side of the lower conveyor 16 for conveyance through the drying/cooling chamber to the discharge 20. While this arrangement has proved satisfactory, there remain problems in obtaining a consistently level bed as well as a rear air seal at the product inlet.

Figure 7:
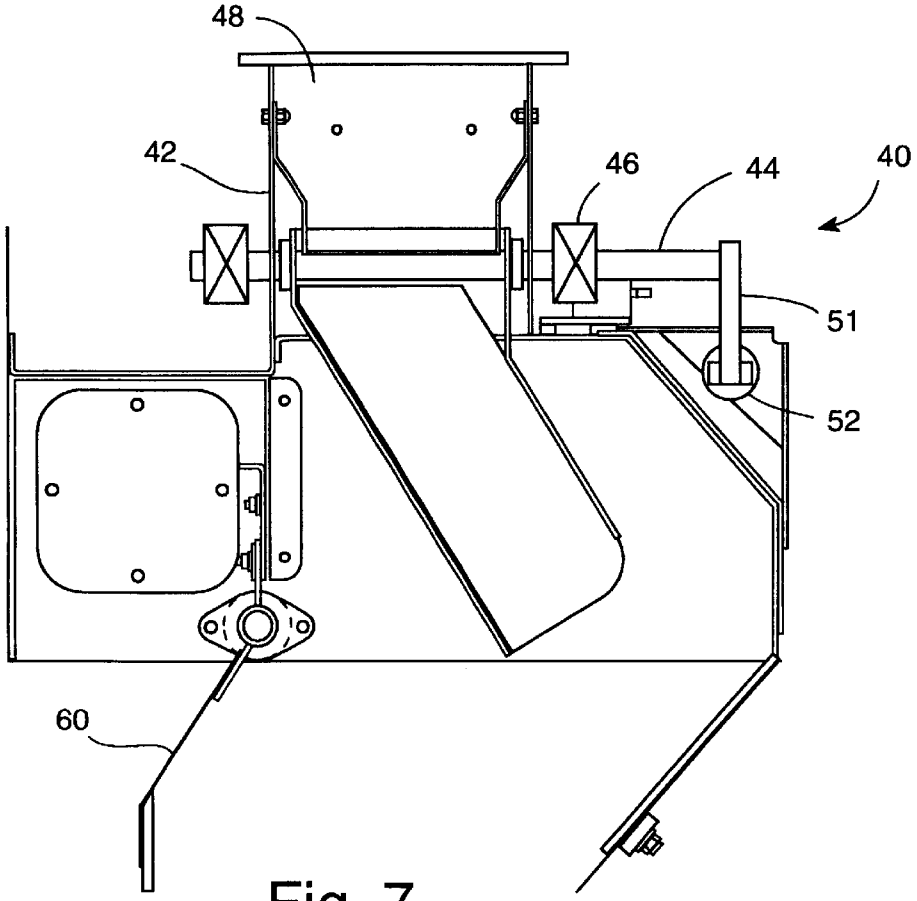
FIG. 7 is an enlarged fragmentary cross-sectional view illustrating the product inlet of FIG. 3.

Referring now to the present invention illustrated in FIGS. 3–8, there is provided a similar type housing with upper and lower conveyors 14 and 16, as well as cooling/drying air inlets along the sides of the housing and an air discharge through the top of the housing. The present invention departs from the cooler/dryer depicted in FIGS. 1 and 2 hereof in the configuration of the product inlet 40. The inlet 40 includes an inlet housing 42 mounting a pivot rod 44 in suitable bearings 46 located outside of the inlet housing 42 and which housing 42 also includes a feeder 48 for receiving product from an external source. As illustrated, the pivot shaft 44 extends axially in the same direction as the direction of movement of the upper conveyor 14 and is centrally located between opposite sides of conveyor 14. Mounted on the pivot shaft 44 and depending therefrom is an angled chute 50 having a base and spaced opposite lateral sides. As best illustrated in FIGS. 3 and 7, the chute 50 extends in a direction generally opposite to the direction of movement of conveyor 14 and the product thereon. That is, the chute extends at an opposite angle to the direction of conveyance of the product on the drying conveyor.

The chute 50 and shaft 44 are oscillated on the bearings 46 by a crank arm 51 attached to an air cylinder 52 at the opposite end of the crank arm. The extension and retraction of the piston of the air cylinder 52 oscillates the shaft 44 and hence the chute 50 side to side as illustrated in FIGS. 5 and 6. Thus, product is distributed substantially evenly between opposite sides of the conveyor as the chute and discharging product traverse between opposite conveyor sides. It will be appreciated that the air cylinder 52 may be replaced by other oscillatory motion imparting devices such as a hydraulic cylinder or an electric motor. Also, the product feed, speed of traverse of the chute and the conveyor speed can be controlled by suitable controls known to those of skill in this art.

Below the chute 50, there is provided an inlet seal plate 54 which is angled in a direction opposite to that of chute 50, i.e., in a direction corresponding to the direction of movement of the upper conveyor 14 and conveyance of the product by conveyor 14. The angled seal plate 54 extends between opposite sides of the housing and terminates at opposite ends slightly inwardly of the opposite transverse ends of the conveyor pans.

Figure 8:
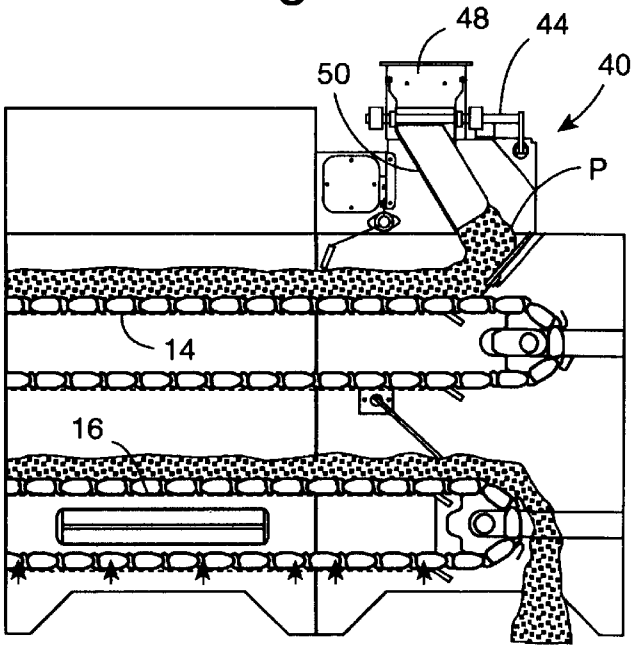
FIG. 8 is a view similar to FIG. 3 illustrating the product being discharged onto the upper conveyor and discharged from the lower conveyor.

In using the cooler/dryer, product P, as illustrated in FIG. 8, is input from the feeder 48 for flow along chute 50 in a direction opposite to the direction of movement of conveyor 14 and movement of product along conveyor 14. The product P discharges from chute 50 onto or against the oppositely angled seal plate 54 for flow downwardly onto the conveyor 14. As the chute 50 is moved, e.g., oscillated from side to side, the product is substantially evenly distributed between opposite sides of the conveyor. Additionally, the product feed rate, speed of traverse of the chute and conveyor speed are controlled such that sufficient product is continuously disposed on the angled seal plate 54 and conveyor. That is, product does not completely discharge onto the conveyor from plate 54 at any transverse location along the conveyor prior to the return of the chute to distribute additional product onto the angled plate at that location. Thus, a continuous seal is formed by and between the seal plate 54 and the conveyor 14 by the product itself. It will therefore be appreciated that the rear seal inlet as disclosed substantially prevents air from cycling around the bed of the product between the conveyor and angled plate 54 which would otherwise reduce the effectiveness of the cooling/drying system.

Additionally, a secondary seal 60 is provided just downstream of the inlet. While the secondary seal may serve a number of functions such as a bed height sensor, it serves as a secondary seal preventing inlet air from being drawn in through the inlet along with the product into the cooling/drying chamber. Seal 60 also serves the level the bed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A horizontal cooler/dryer comprising:

a housing having a product inlet, a product discharge, a gas inlet, a gas exhaust, and a gas chamber for passing gas from said gas inlet to said gas exhaust;

a conveyor within said housing for receiving product from said product inlet and conveying the product in a first direction from said product inlet through said gas chamber to said product discharge to cool and dry the product;

a seal plate carried by said housing above said conveyor and angled in the direction of conveyance of the product on the conveyor;

said product inlet including a chute for receiving product from an external source and flowing the product onto said plate in a direction generally opposite to the direction of conveyance of the product on the conveyor, thereby forming an air seal between the conveyor and the seal plate.

2. A cooler/dryer according to claim 1 wherein said chute is mounted for movement in a direction to spread the product between opposite transverse edges of the conveyor and thereby provide a substantial level product bed on the conveyor, and a motion imparting device coupled to said chute for moving said chute.

3. A cooler/dryer according to claim 1 wherein said chute is mounted for oscillatory movement in directions generally toward opposite sides of said conveyor and an oscillatory motion imparting device coupled to said chute for oscillating said chute.

4. A cooler/dryer according to claim 1 including a secondary seal downstream in the direction of said conveyor from said air seal for sealing said product inlet from said gas chamber.

5. A cooler/dryer according to claim 1 wherein said chute is mounted for oscillatory movement in directions generally toward opposite sides of said conveyor and an oscillatory motion imparting device coupled to said chute for oscillating said chute, said chute being mounted for oscillatory movement about an axis extending in said first direction and a fluid cylinder coupled to said chute for oscillating said chute about said axis to spread the product between opposite transverse edges of the conveyor and provide a substantially level product bed.

6. A cooler/dryer according to claim 5 including a secondary seal downstream in the direction of said conveyor from said air seal for sealing said product inlet from said gas chamber.

7. A cooler/dryer according to claim 1 wherein said continuous conveyor includes a first conveyor and a second conveyor underlying said first conveyor for conveying product received from a discharge end of said first conveyor to said product discharge.

* * * * *